US008202138B2

(12) United States Patent
Lai

(10) Patent No.: US 8,202,138 B2
(45) Date of Patent: Jun. 19, 2012

(54) SIMULATED EYE FOR TOY

(75) Inventor: Jin-Shi Lai, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 361 days.

(21) Appl. No.: 12/558,594

(22) Filed: Sep. 14, 2009

(65) Prior Publication Data

US 2010/0120326 A1 May 13, 2010

(30) Foreign Application Priority Data

Nov. 12, 2008 (CN) ..... 2008 1 0305516

(51) Int. Cl.
*A63H 3/38* (2006.01)

(52) U.S. Cl. ..... 446/392; 446/389

(58) Field of Classification Search ..... 446/389, 446/392, 330, 391; 623/4.1
See application file for complete search history.

(56) References Cited

U.S. PATENT DOCUMENTS

| | | | | |
|---|---|---|---|---|
| 2,922,253 | A * | 1/1960 | Carter | 446/303 |
| 3,905,130 | A * | 9/1975 | Gordon et al. | 434/271 |
| 4,773,889 | A * | 9/1988 | Rosenwinkel et al. | 446/448 |
| 5,108,427 | A * | 4/1992 | Majercik et al. | 623/5.12 |
| 5,900,923 | A * | 5/1999 | Prendergast et al. | 351/221 |
| 5,951,363 | A * | 9/1999 | Uetake | 446/470 |
| 6,391,057 | B1 * | 5/2002 | Schleipman et al. | 623/6.64 |
| 6,988,927 | B2 * | 1/2006 | Gingold et al. | 446/175 |
| 7,485,025 | B2 * | 2/2009 | Schnuckle | 446/392 |

FOREIGN PATENT DOCUMENTS

GB 1392431 A * 4/1975

* cited by examiner

*Primary Examiner* — Gene Kim
*Assistant Examiner* — Alyssa Hylinski
(74) *Attorney, Agent, or Firm* — Altis Law Group, Inc.

(57) ABSTRACT

A simulated eye is capable of being changed between a contracted state and a dilated state. The simulated eye includes a housing having at least one guiding post, a driving device housed in the housing, a transmission member movably coupled to the driving device, an eyeball having a transparent portion, an elastic film including a simulated pupil, and a stopper. The simulated pupil is viewable at the transparent portion. The stopper is attached to the at least one guiding post, and is sandwiched between the elastic film and the transmission member. When the driving device drives the transmission member, a size of the simulated pupil is changeable, whereby the simulated eye is changed between the contracted state and the dilated state.

9 Claims, 4 Drawing Sheets

SIMULATED EYE FOR TOY

BACKGROUND

1. Technical Field

The disclosure relates to toys and, more particularly, to a simulated eye for a toy.

2. Description of Related Art

With the development of electronic technology, more and more robot toys simulate people's actions, such as, walking, jumping, and so on. As known, eyes are one of the most important organs of the human body, and people can express various emotions via the eyes. The eyes of some robot toys simulate human eyes, however, some of these simulations are limited to the eyelids opening and closing, and accordingly, other simulation effects of the eyes of the robot toys are needed to make the robot looks more lifelike. Therefore, what is needed is a simulated eye having more lifelike actions.

BRIEF DESCRIPTION OF THE DRAWINGS

The components of the drawings are not necessarily drawn to scale, the emphasis instead being placed upon clearly illustrating the principles of the embodiments of the simulated eye. Moreover, in the drawings, like reference numerals designate corresponding parts throughout several views.

DETAILED DESCRIPTION

Figure 1:
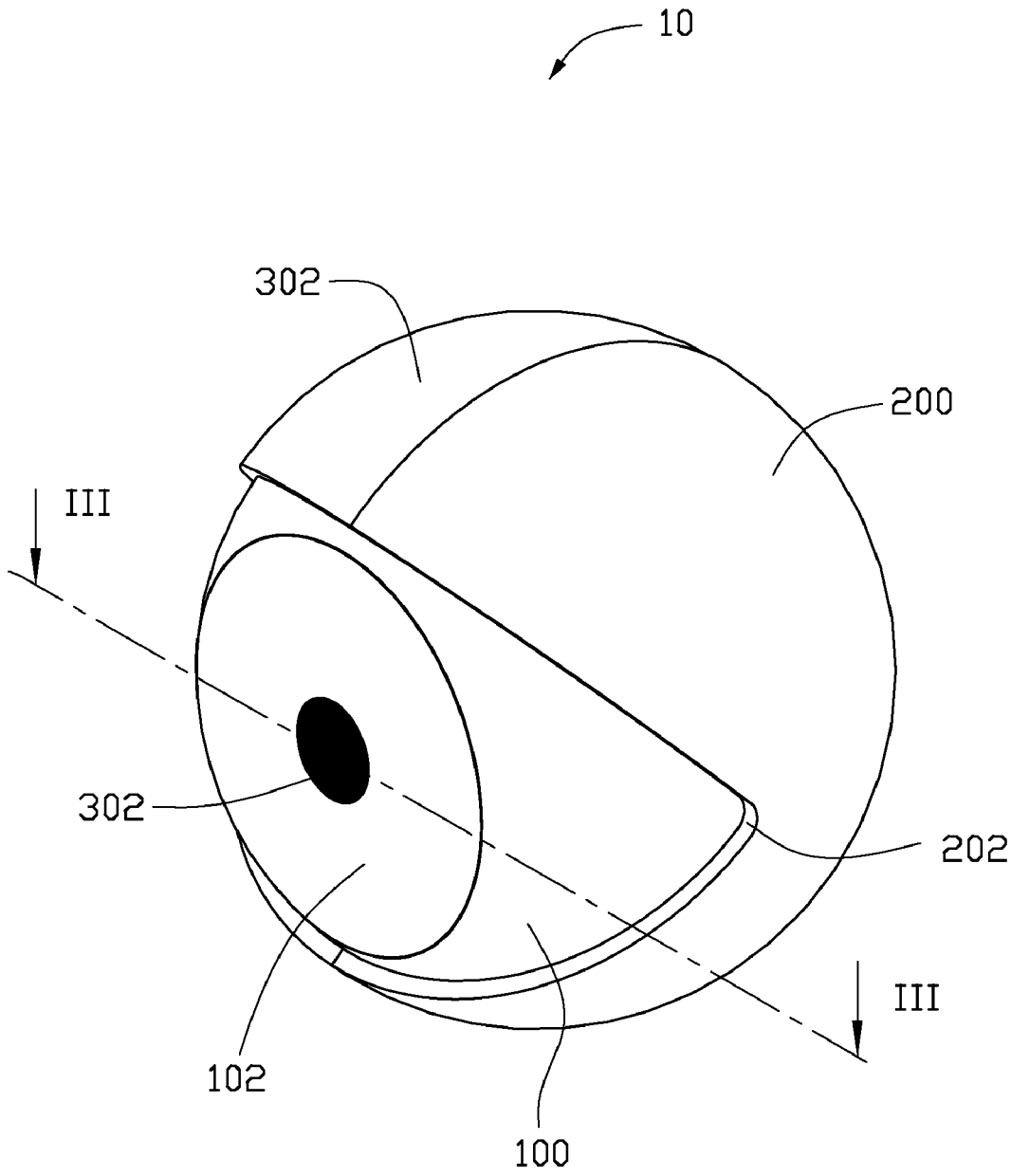
FIG. 1 is a perspective view of a simulated eye having a simulated pupil in accordance with one embodiment, showing the simulated pupil in a normal state.

Referring to FIG. 1, a simulated eye 10 includes an eyeball 100, a simulated pupil 302, and a spherical housing 200. The eyeball 100 is housed in the housing 200 and includes a transparent portion 102. An opening 202 is defined in the housing 200. The transparent portion 102 is exposed at the opening 202. The simulated pupil 302 is viewable at the transparent portion 102.

Figure 2:
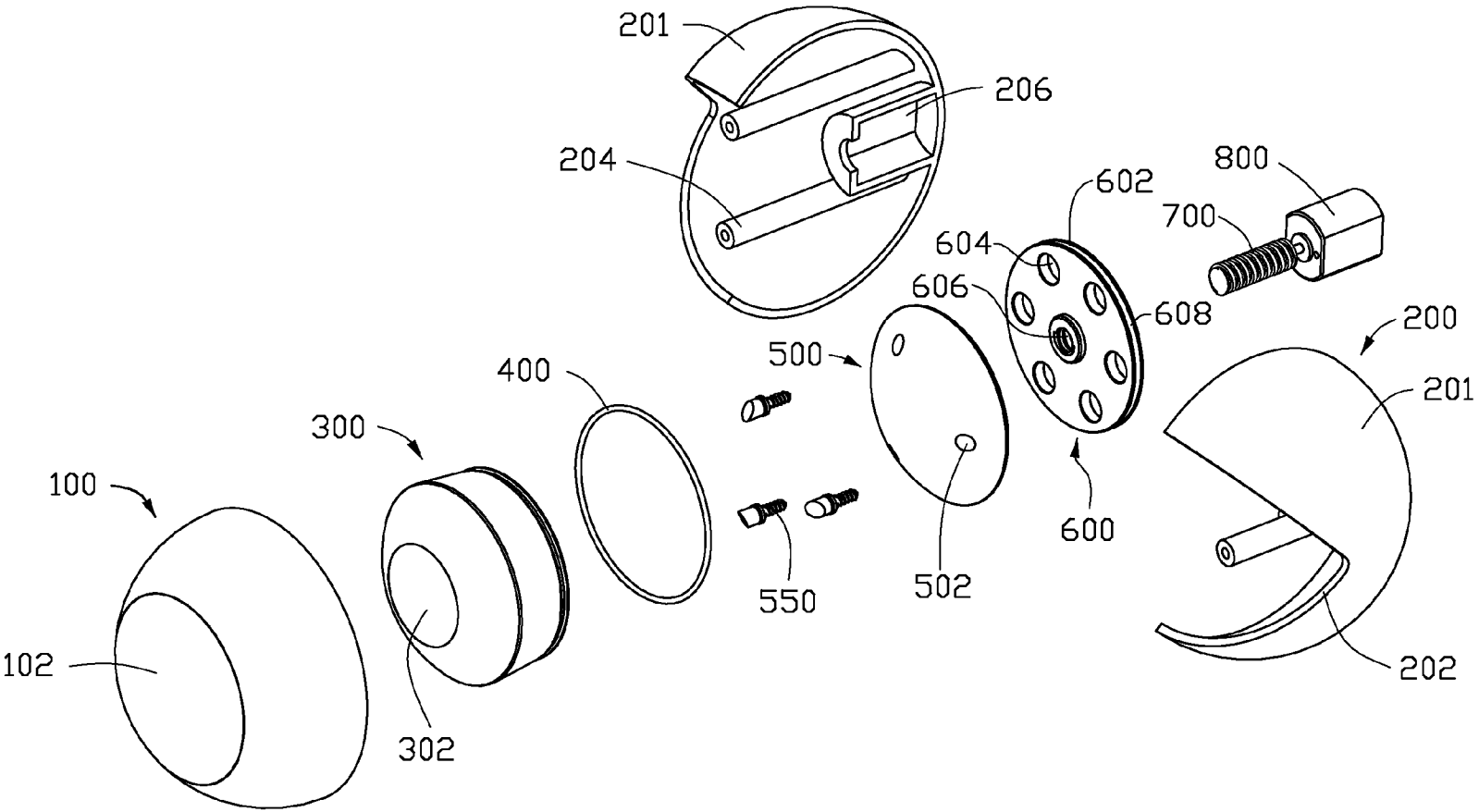
FIG. 2 is an exploded view of the simulated eye of FIG. 1.

Referring to FIG. 2, the housing 200 is divided into two parts 201. The housing 200 includes at least two guiding posts 204 and a holding member 206. In the embodiment, the number of the guiding posts 204 is three. The guiding posts 204 protrude inwardly from the housing 200 and are parallel with each other. The holding member 206 is surrounded by the three guiding posts 204.

The simulated eye 10 further includes an elastic film 300, a fixing member 400, a stopper 500, a transmission member 600, and a driving device 800.

The elastic film 300 is a cylindrical sleeve, and is elastically deformed to store elastic energy when pulled tight. The simulated pupil 302 is disposed on the elastic film 300. The simulated pupil 302 may be a part of the elastic film 300. The simulated pupil 302 is circular and colored. The color of the simulated pupil 302 can be black, blue, brown, and so on.

The fixing member 400 is annular and is configured to fix the elastic film 300 to the transmission member 600. In the embodiment, the fixing member 400 is an elastic element, such as, a rubber band.

The stopper 500 is substantially quarter of a sphere. A plurality of through holes 502 is defined in the stopper 500 corresponding to the guiding posts 204.

A threaded hole 606 is defined at the center of the transmission member 600. A plurality of round holes 604 are symmetrically disposed on the transmission member 600 and are adjacent to a rim 602 thereof. An annular groove 608 is defined in the rim 602. The diameter of the annular groove 608 is longer than that of the fixing member 400.

The driving device 800 is held in the holding member 206 and includes a driving member 700. The driving member 700 is mechanically coupled to the driving device 800 and is driven to rotate thereby. A plurality of threads are disposed on the driving member 700.

In assembly, the driving device 800 is held in the holding member 206. The driving member 700 threadedly engages into the threaded hole 606. At the same time, the guiding posts 204 extend though the corresponding round holes 604. A plurality of bolts 550 extend through the through hole 502 to fix the stopper 500 to the guiding posts 204. The elastic film 300 accommodating the stopper 500 is placed over the transmission member 600, and is further locked into the annular groove 608 via the fixing member 400. The eyeball 100 is housed in the housing 200 by fixing the two parts 201 of the housing 200 together.

Figure 3:
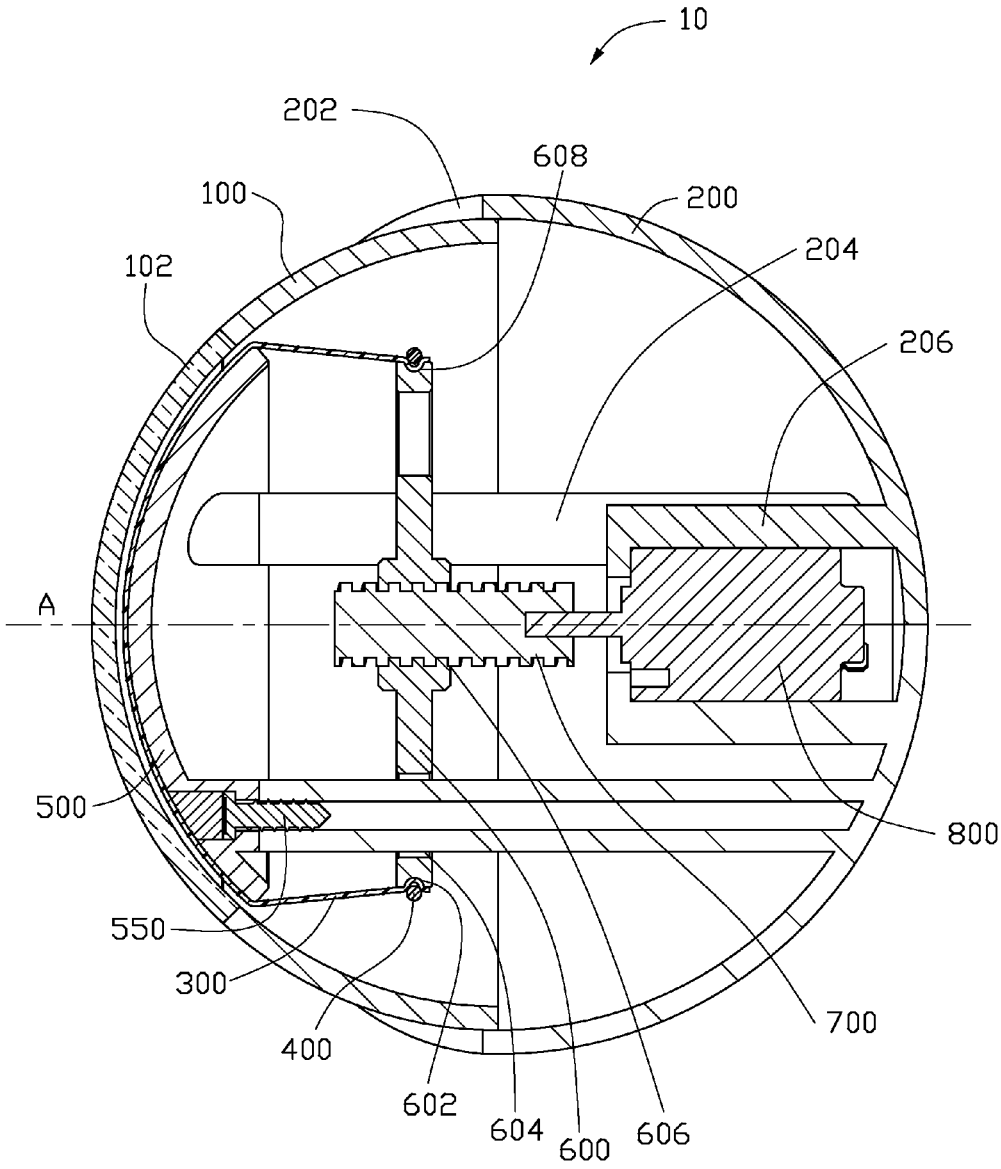
FIG. 3 is a cross-sectional view taken along line III-III of FIG. 1.

Referring to FIG. 3, after assembly, the center of the transparent portion 102, the simulated pupil 302, the center of the stopper 500, the threaded hole 606, and the driving device 700 are aligned in a straight line A, and the guiding posts 204 are parallel with the straight line A. The transmission member 600 rotatably coupled to the driving device 700 is rotatable relative thereto. Because the guiding posts 204 extend through the corresponding round holes 604, the transmission member 600 cannot rotate with the driving member 700, but is movable in the axial direction thereof while being driven thereby. The stopper 500 attached to the guiding posts 204 is for limiting the range of movement of the transmission member 600 between the stopper 500 and the driving device 800. The stopper 500 is further sandwiched between the elastic film 300 and the transmission member 600. Thus, when the transmission member 600 is driven to move away from the stopper 500, the stopper 500 stops the elastic film 300 moving toward the driving device 800.

Referring to FIG. 1, when the elastic film 300 is not stretched or pulled by the transmission member 600, the simulated pupil 302 is in its original size. In this state, the simulated eye 10 is said to be in a normal state.

Figure 4:
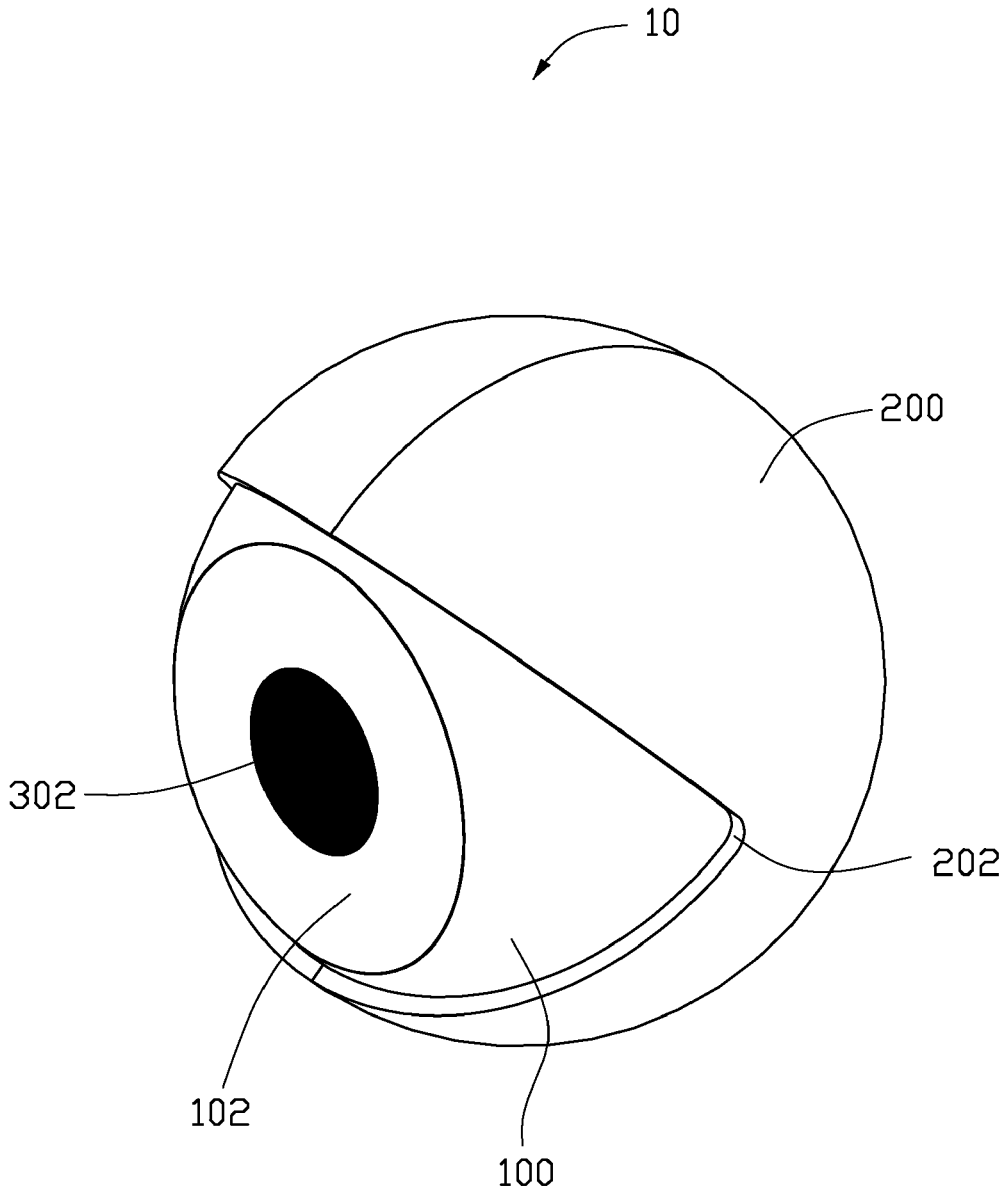
FIG. 4 is a perspective view of the simulated eye, showing the simulated pupil in a dilated state.

Referring to FIG. 4, when the driving member 700 is driven to rotate by the driving device 800, the transmission member 600 is driven to move away from the stopper 500, and the elastic film 300 is stretched by the transmission member 600. Accordingly, the elastic film 300 is elastically deformed to store elastic energy. As a result, the colored area of the simulated pupil 302 is enlarged, that is, the simulated pupil 302 is dilated and is changed from the normal state to a dilated state.

When the driving device 800 is turned off, the elastic film 300 releases the elastic energy to drive the transmission member 600 to the original position, and the colored area of the simulated pupil 302 resumes original size. As a result, the simulated eye 10 seems to be changed from the dilated state to the normal state. Furthermore, in another embodiment, the transmission member 600 is driven to move to the original position via the driving device 800 driving the driving member 700 to rotate in a reverse direction, such that the colored area of the simulated pupil 302 resumes original size.

Therefore, by operationally changing the size of the colored area of the simulated pupil via the driving device 800, the simulated eye 10 is changeable between the normal state and the dilated state.

Although the present disclosure has been specifically described on the basis of the embodiments thereof, the disclosure is not to be construed as being limited thereto. Various changes or modifications may be made to the embodiments without departing from the scope and spirit of the disclosure.

What is claimed is:

1. A simulated eye, comprising:

a driving device;

at least one guiding post;

an eyeball comprising a transparent portion;

a simulated pupil;

an elastic film formed in a cylindrical shape, wherein the simulated pupil is disposed on the elastic film, and is viewable at the transparent portion;

a stopper attached to the at least one guiding post; and a transmission member movably coupled to the driving device;

wherein the transmission member is limited by the at least one guiding post and is slidably coupled thereto, the elastic film is fixed to the transmission member, and the stopper is sandwiched between the transmission member and the elastic film, the elastic film is abutted by the stopper and is stretched while the transmission member is driven by the driving device to move away from the stopper, thereby the simulated pupil simulates expansion.

2. The simulated eye of claim 1, wherein the driving device comprises a driving member having threads, a threaded hole is defined in the transmission member, the driving member threadedly engages into the threaded hole.

3. The simulated eye of claim 1, wherein at least one round hole is defined in the transmission member, the at least one guiding post extends through the at least one round hole.

4. The simulated eye of claim 1, further comprising a fixing member, the elastic film attached to the transmission member via the fixing member.

5. The simulated eye of claim 2, wherein a groove portion is defined at a rim of the transmission member, the elastic film is attached in the groove portion via the fixing member.

6. The simulated eye of claim 1, wherein at least one through hole is defined in the stopper, the stopper is attached to the at least one guiding post via the at least one through hole.

7. The simulated eye of claim 1, wherein the simulated pupil is colored.

8. The simulated eye of claim 1, further comprising a housing, the eyeball, the stopper, the elastic film, the transmission member, and the driving device are housed in the housing.

9. The simulated eye of claim 8, wherein an opening is defined in the housing, the transparent portion is exposed at the opening.

* * * * *